United States Patent [19]

Rice

[11] 4,235,204

[45] Nov. 25, 1980

[54] FUEL CONTROL WITH LEARNING CAPABILITY FOR MOTOR VEHICLE COMBUSTION ENGINE

[75] Inventor: John O. Rice, Utica, Mich.

[73] Assignee: General Motors Corporation, Detroit, Mich.

[21] Appl. No.: 26,243

[22] Filed: Apr. 2, 1979

Related U.S. Application Data

[63] Continuation-in-part of Ser. No. 827,742, Aug. 25, 1977, abandoned.

[51] Int. Cl.[3] ..... F02M 7/00; F02M 51/00

[52] U.S. Cl. ..... 123/440; 123/480; 123/486; 123/488; 60/276; 364/431; 123/489

[58] Field of Search ..... 123/32 EE, 32 EB, 32 EC, 123/32 ED, 119 EC; 60/276, 285; 364/424, 431, 442

[56] References Cited

U.S. PATENT DOCUMENTS

| | | | |
|---|---|---|---|
| 3,895,611 | 7/1975 | Endo et al. | 123/32 EE |
| 4,048,965 | 9/1977 | Bianchi et al. | 123/32 EB |
| 4,075,835 | 2/1978 | Hattori et al. | 123/119 EC |
| 4,130,095 | 12/1978 | Bowler et al. | 123/32 EE |
| 4,166,437 | 9/1979 | Bianchi et al. | 123/32 EE |

*Primary Examiner*—Charles J. Myhre
*Assistant Examiner*—Andrew M. Dolinar
*Attorney, Agent, or Firm*—Robert M. Sigler

[57] ABSTRACT

A motor vehicle combustion engine has exhaust apparatus including a sensor for sensing exhaust content therein and fuel control apparatus determining fuel supply to the engine in accordance with an engine operating condition and a trimming factor which is a function of the engine operating condition, the values of the trimming factor corresponding to different values of the engine operating condition being chosen to help maintain a predetermined exhaust content. The engine and fuel apparatus are characterized by a transport delay between the time a change is initiated in fuel supply and the time a resulting change in exhaust content can be sensed. In its broadest aspect, the fuel supply apparatus samples successive values of the engine operating condition and, when the value of the engine operating condition is substantially the same for a time period at least equal to the transport delay and there is a difference between the exhaust content after the time period and a desired exhaust content, changes the value of the trimming factor corresponding to the value of the engine operating condition during the time period in sense to reduce the difference. In a further aspect, where the apparatus time-integrates the exhaust content, the time integral is changed as the trimming factor is changed to prevent over-correction of the trimming factor due to time delay effects in the integration. In still another aspect, the apparatus delays changing the trimming factor while the difference between the actual and desired exhaust contents is changing toward zero.

14 Claims, 14 Drawing Figures

FUEL CONTROL WITH LEARNING CAPABILITY FOR MOTOR VEHICLE COMBUSTION ENGINE

BACKGROUND OF THE INVENTION

This application is a continuation-in-part of application Ser. No. 827,742, filed Aug. 25, 1977, abandoned.

The type and amount of combustion products present in the exhaust of a combustion engine are determined in large part by the ratio of air to fuel in the mixture supplied to the engine. In an effort to reduce the amount of certain undesirable components in the exhaust of motor vehicle combustion engines, it has been proposed to use certain catalytic converters, known as "three-way" catalytic converters, which simultaneously oxidize hydrocarbons and carbon monoxides and reduce oxides of nitrogen if provided with a stoichiometric exhaust content. Since stoichiometry of exhaust content is determined greatly by the air/fuel ratio of the fuel supply means, exact control of the air/fuel mixture of the fuel supply means is desirable for maximum efficiency in the reduction of undesirable exhaust components by this method.

In one type of prior art fuel control, the fuel supply apparatus has a fuel delivery rate which is a predetermined function of one or more engine operating variables, such as engine load and speed or mass airflow. In this type of system, generally termed an open loop system, the function is generally predetermined to provide an expected air/fuel ratio at all values of the engine operating variables. However, the exact control of air/fuel ratio desired for the previously mentioned catalytic converter, combined with unavoidable errors introduced by factors such as changes in engine components with time, fuel variations, etc. place a practical limit on the effectiveness of pure open loop control.

Closed loop control has been proposed for combustion engine fuel supply. The most common system proposed provides a sensor such as a zirconia oxygen sensor in the exhaust means, which sensor senses the oxidizing content of the exhaust and provides an output signal which shifts rather abruptly between two voltage levels with small changes in the air/fuel ratio around stoichiometry. This signal can be used to control the air/fuel ratio in the fuel supply means in closed loop fashion to maintain the desired exhaust content.

Closed loop fuel control system of this type can provide relatively accurate fuel/air control under constant or slowly varying engine operating conditions, but under varying conditions they are subject to errors due to the time delays inherent in the engine-vehicle system. If the engine and vehicle are operating under conditions wherein the fuel metering is not exactly correct, a time period (e.g., 1 second) may elapse between the initiation of the engine conditions at the engine fuel intake and the response of the exhaust sensor which calls for a correction. By this time, however, the vehicle and engine may be operating under different conditions where a different correction, or perhaps no correction at all, is needed. Consequently, during transient engine operating conditions, the fuel supply correction is, in effect, chasing a moving target and may produce corrections too late to maintain the air/fuel ratio at the desired value, with consequent emission levels of undesirable exhaust components which are higher than desired.

The form of error described above primarily results from the engine system transport delay between the introduction of fuel into the engine intake and the sensing of the combustion products of the fuel in the engine exhaust. Components of this transport delay include the time required for the change in the mixture of air and fuel to appear at the engine cylinder intake ports, the time for the cylinders to perform intake, compression, power and exhaust strokes, the time for the exhaust pipe gas to respond to the change in the exhaust gas discharge from cylinders and the time for the exhaust gas to travel to the sensor. In addition to this transport delay, there are other delays in the system which may also decrease the ability of a closed loop system to accurately maintain a desired air/fuel ratio.

SUMMARY OF THE INVENTION

This invention relates to fuel control for motor vehicle engines of the type which maintains a substantially constant exhaust content at or near stoichiometry. It further relates to such a system in which fuel supply is determined by an engine operating condition and a trimming factor which is a function of the engine operating condition. The trimming factor function may be stored in tabular form in a memory with the various values of the trimming factor associated with the corresponding values of the engine operating condition or conditions.

It is an object of this invention to provide a fuel control with updated calibration or trimming factor values that advantageously utilize the engine operating events where conditions are maintained substantially constant for at least the engine transport delay time.

Still another object of this invention is to provide an adaptive learning control system wherein the engine operating condition is sampled at successive times and advantage is taken of the probability that a series of successive samples of substantially the same value represents uniform engine operation over the period of such successive samples.

In particular, this invention provides apparatus effective to successively sample the values of a parameter indicative of engine operating condition and determine whether the engine operating condition has been substantially unchanged for a period of time equal to the engine transport delay. It if has, then it is certain that the engine operating condition has contributed at least partially to the exhaust content at the end of the period. That exhaust content may then be sensed and compared with a predetermined desired content; and the trimming factor specific to the sensed engine operating condition which helped produce that exhaust content may be adjusted according to the difference between actual and desired exhaust contents.

This invention is an improvement on the system described in the U.S. Pat. No. 4,130,095 to Lauren L. Bowler and John E. Lahiff.

One embodiment of this invention, which uses the time-integral of the exhaust content to help determine fuel supply, alters this time-integral when the trimming factor is changed and in similar amount to eliminate the time delay due to integration back to the desired exhaust content and thus prevent possible overcorrection of the trimming factor. In another embodiment of this invention, the error of the time-integral of the exhaust content is checked prior to adjustment of the trimming factor to see if it is moving toward zero; and, if it is, adjustment of the trimming factor is delayed until the error stops moving toward zero. Thus, account is taken of the possibility that the error at the second time may be only partially due, or due not at all, to the trimming factor at the first time and the trimming factor may not need as large or, perhaps, any alteration at that specific engine operating condition.

Further details and objects of this invention will be apparent from the accompanying drawings and the following description of a preferred embodiment.

DESCRIPTION OF THE PREFERRED EMBODIMENT

Figure 1:
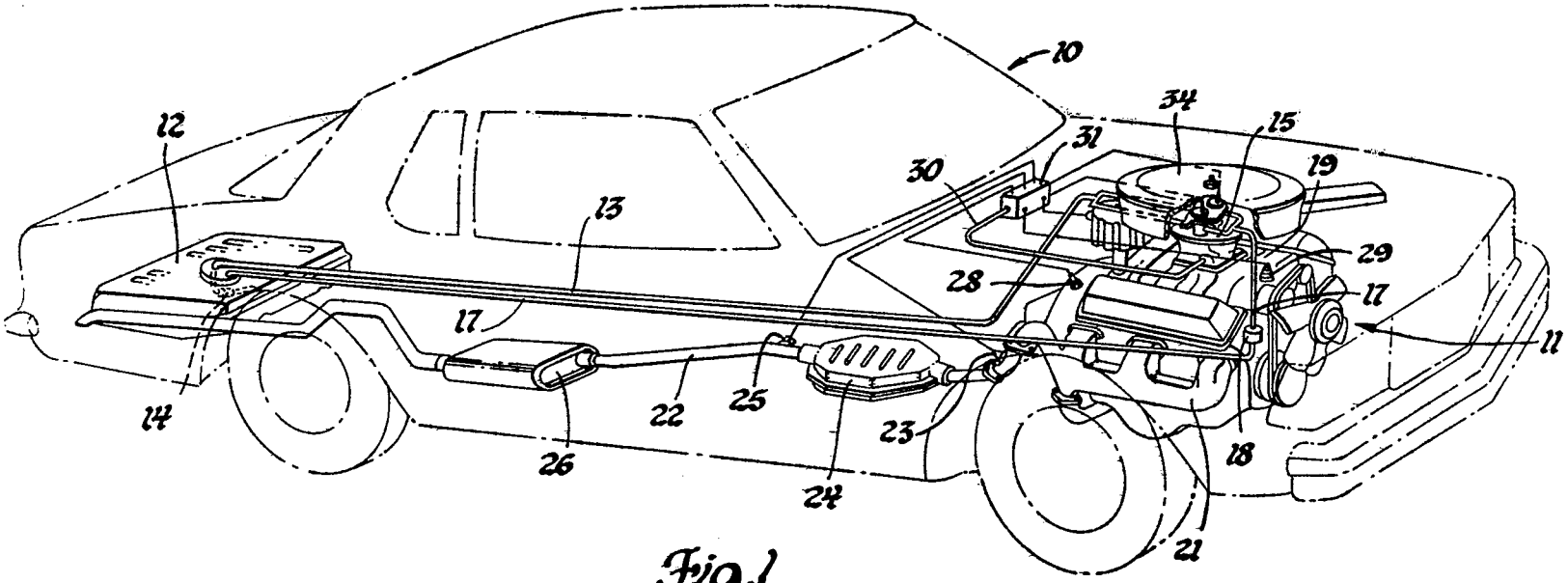
FIG. 1 shows a motor vehicle with an engine and fuel supply apparatus according to this invention.

Referring to FIG. 1, a motor vehicle 10 is provided with a combustion engine 11 and suitable additional drive apparatus, not shown. Engine 11 is equipped with fuel supply apparatus including a fuel tank 12, fuel supply line 13, fuel pump 14, fuel/air mixing and supply apparatus 15, and, if required, a fuel return line 17 and pressure regulator 18. The latter are normally used if the fuel/air supply apparatus 15 takes the form of a fuel injection system as shown here, although this invention equally applies to other air/fuel delivery apparatus such as, for example, a carburetor. The fuel/air mixture from apparatus 15 is supplied to engine 11 through an intake manifold 19.

The exhaust system for engine 11 includes an exhaust manifold 21, exhaust pipe 22, first exhaust sensor 23, "three-way" catalytic converter 24, second exhaust sensor 25 and muffler 26. As seen in FIG. 1, the first and second exhaust sensors 23 and 25 are located in exhaust pipe 22 so as to sense the exhaust gases flowing therethrough; and first exhaust sensor 23 is located upstream from catalytic converter 24 while second sensor 25 is located just downstream therefrom.

FIG. 1 also shows an engine speed pickup 28, which may be a typical magnetic pickup to sense the passage of teeth on the perimeter of the vehicle flywheel and generate a pulsed signal in timed relation thereto. FIG. 1 further shows a vehicle coolant temperature sensor 29, a conduit 30 for conveying manifold absolute pressure and a box 31 representing the fuel control apparatus, mostly electronic, which is shown in block diagram form in FIG. 4.

Figure 2:
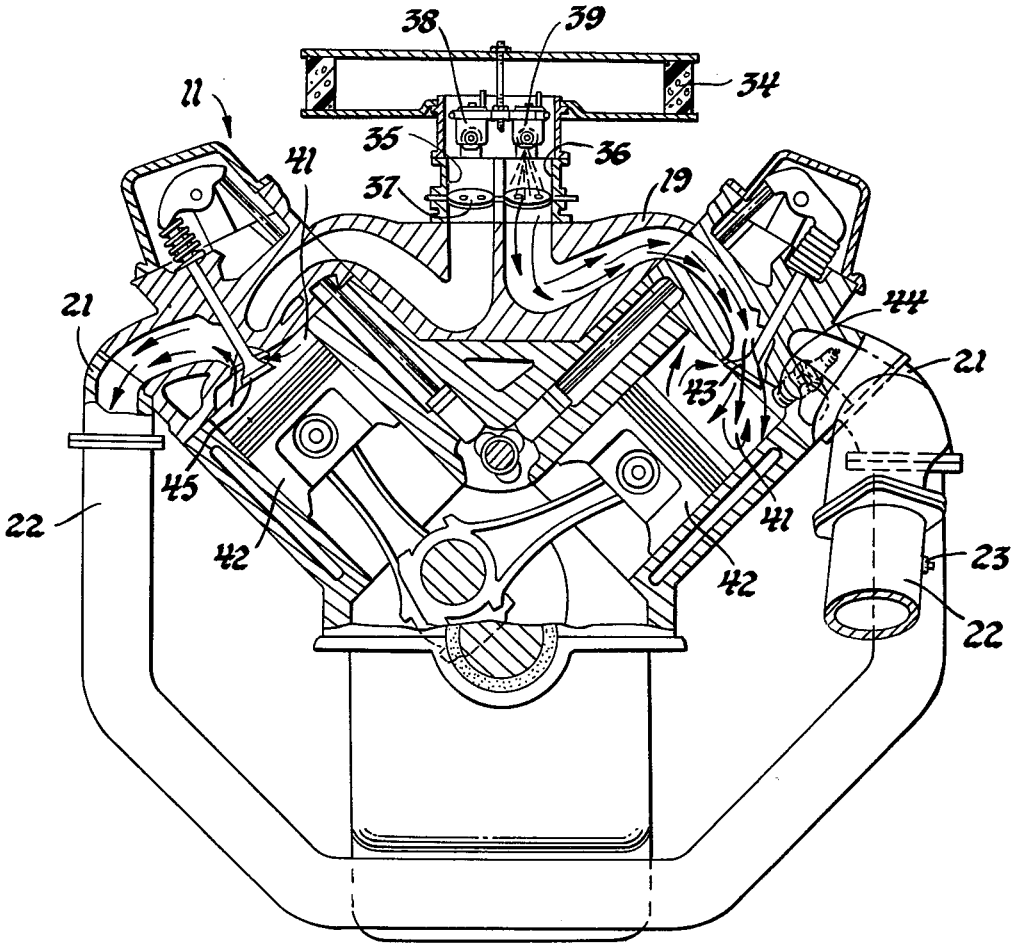
FIG. 2 shows a cutaway view of the engine in the vehicle of FIG. 1.
Figure 3:
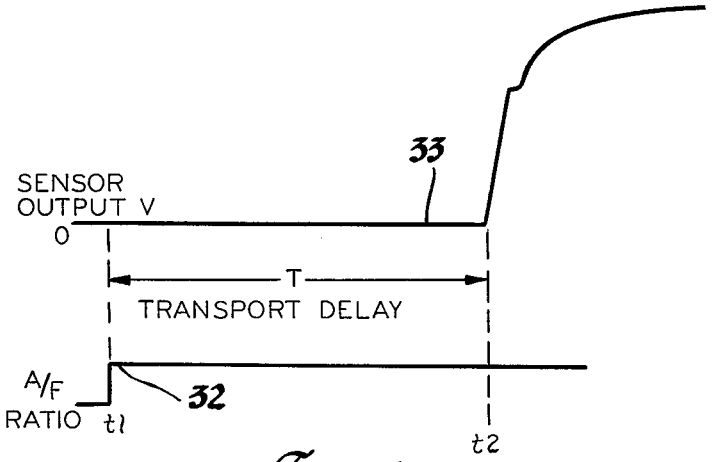
FIG. 3 shows a graphical representation of transport delay in the engine of FIG. 2.

FIGS. 2 and 3 describe the characteristic known as transport delay with regard to the passage of fuel into and through the engine 11. Referring to FIG. 2, air enters engine 11 through air cleaner 34 and is drawn into throttle bores 35 and 36 past throttle 37 into intake manifold 19. Fuel in liquid form is injected into this moving airstream in a controlled manner by solenoid type injectors 38 and 39 located above throttle bores 35 and 36. The amount of fuel injected by injectors 38 and 39 with relation to the mass flow of air through throttle bores 35 and 36 determine the air/fuel ratio provided to engine 11.

The mixture of air and fuel proceeds through intake manifold 19 to the cylinders 41, drawn in by the receding piston 42 through the open intake valve 43 during the engine intake stroke. The fuel mixture is compressed in cylinder 41 and ignited by a spark plug 44 to burn, expand and impart energy to piston 42. During the engine exhaust stroke, the combustion products and other constituents of the exhaust gases are pushed out of cylinder 41 by piston 42 through the open exhaust valve 45 into exhaust manifold 21 and exhaust pipe 22, where a portion of these exhaust gases finally come in contact with the first exhaust sensor 23.

Referring to FIG. 3, if a step change in air/fuel ratio, as seen in curve 32, is introduced by means of injectors 38 and 39 at time T1, the resultant change in the output voltage of sensor 23, as seen in curve 33, will not occur until a time T2, which is later than time T1 by the transport delay of engine 11. This transport delay is, of course, not constant but varies with a number of environmental factors and engine operating variables, the most important of which is engine speed.

In further references to transport delay in this description, it is to be understood that there are a number of ways in which the figure used for transport delay may be derived. A first way is to determine the maximum transport delay to be expected in normal engine operation and use that time as a single constant transport delay. This is the simplest and least expensive method. An alternative is to provide apparatus for computing or retrieving from memory a figure based on engine speed and, perhaps, other factors, which figure is always just slightly greater than the actual transport delay. This method has the advantage of more closely following the actual transport delay as the engine operates; but it also introduces greater complexity and expense into the system.

Figure 4:
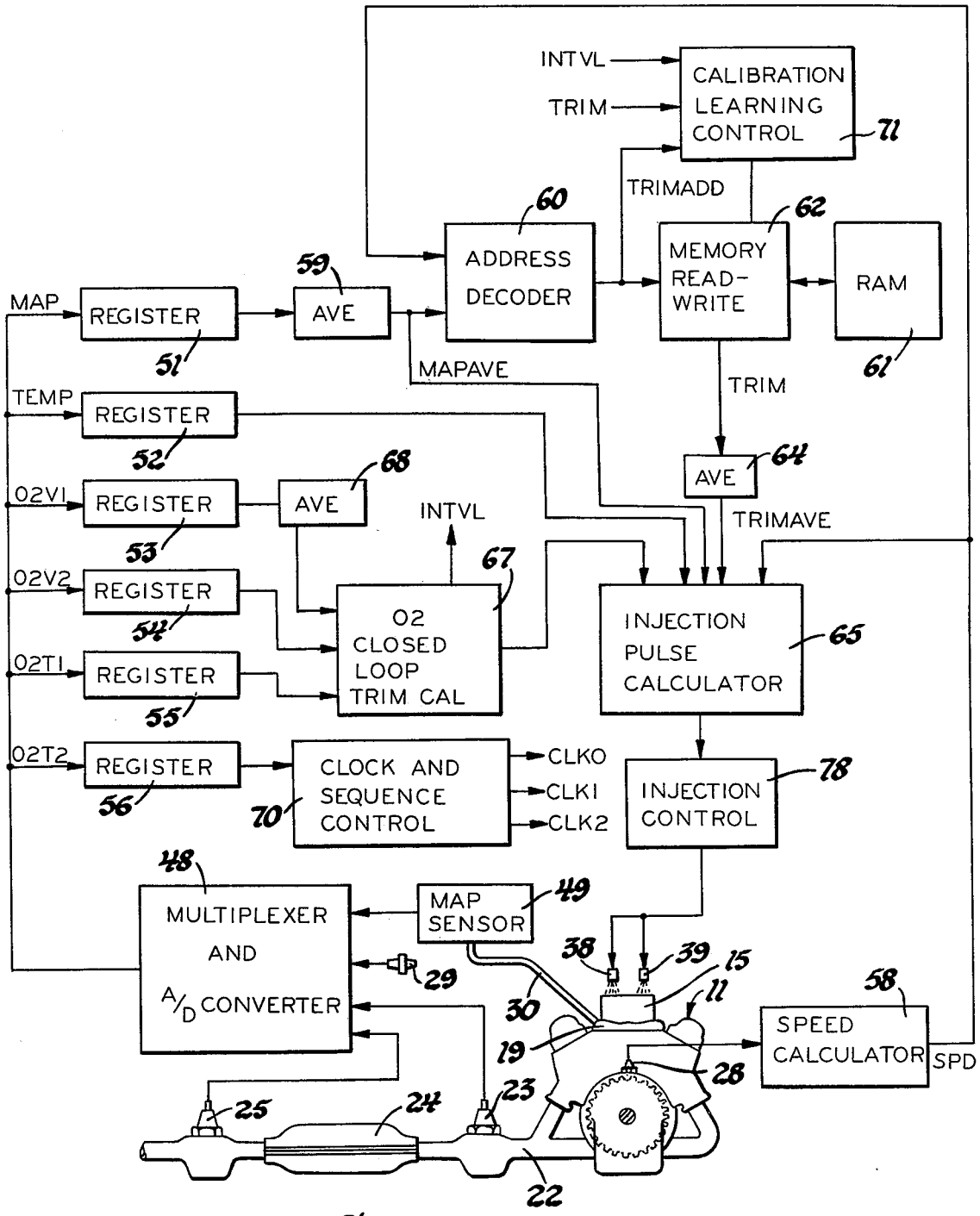
FIG. 4 shows the fuel supply system of this invention in block diagram form in conjunction with the engine of FIG. 2.

Referring to FIG. 4, the overall organization and operation of the fuel supply apparatus will be described. The multiplexer and analog/digital converter 48 has inputs from exhaust sensors 23 and 25, temperature sensor 29 and a MAP sensor 49, which is, in turn, connected to MAP conduit 30. Multiplexer and A/D converter 48 is provided with timing signals to sample its inputs on a time-sharing basis, convert the analog input voltages to digital signals and provide each digital signal to an appropriate one of registers 51–56. As indicated in FIG. 4, the registers are identified as follows: register 51 is provided with the manifold absolute pressure MAP; register 52 is provided with the engine coolant temperature TEMP; register 53 is provided with the first oxygen sensor oxygen signal 02V1; register 54 is provided with the second oxygen sensor signal 02V2; register 55 is provided with the first oxygen sensor temperature signal 02T1; and register 56 is provided with the second oxygen sensor temperature signal 02T2.

A speed calculator circuit 58 receives the signal from speed pickup 28 and supplies a speed signal SPD to an address decoder 60. An averaging circuit 59 receives consecutive values of MAP from register 51 and computes a signal MAPAVE, which is also provided to address decoder 60. Address decoder 60 generates, from the values of SPD and MAPAVE, the address of a particular value of the trimming factor in a random access memory or RAM 61, preferably of the non-volatile type, and commands memory read-write apparatus 62 to produce this value, signified as TRIM, from RAM 61 and provide it to an averaging circuit 64. Averaging circuit 64 is similar to averaging circuit 59 and provides an output TRIMAVE to an injection pulse calculator 65. Injection pulse calculator 65 also receives inputs of SPD from speed calculator 58, TEMP from register 52, MAPAVE from averaging circuit 59 and optionally, a closed loop trim factor from an 02 closed loop calculator 67.

02 closed loop trim calculator 67 receives inputs 02T1 from register 55, 02V2 from register 54 and 02V1 AVE from an averaging circuit 68, similar to averaging circuit 59, which receives consecutive values of 02V1 from register 53. A clock and sequence control 70 provides the necessary timing pulses CLK0, CLK1 and CLK2 and sequence pulses for actuating each part of the apparatus at the proper time and in the proper sequence. The system of FIG. 4 also includes a calibration learning control 71, to be described in detail at a later point.

Although the apparatus shown in this embodiment is composed of discrete electronic elements, mostly digital, it is understood that this invention also contemplates the use of a programmed minicomputer based on a microprocessor which accomplishes the same functions in substantially the same manner. The clock and sequence control 70 would, in that case, correspond to the computer clock and program counter, with the sequence pulses, to be described later in this specification, corresponding to steps in a computer program.

Figure 5:
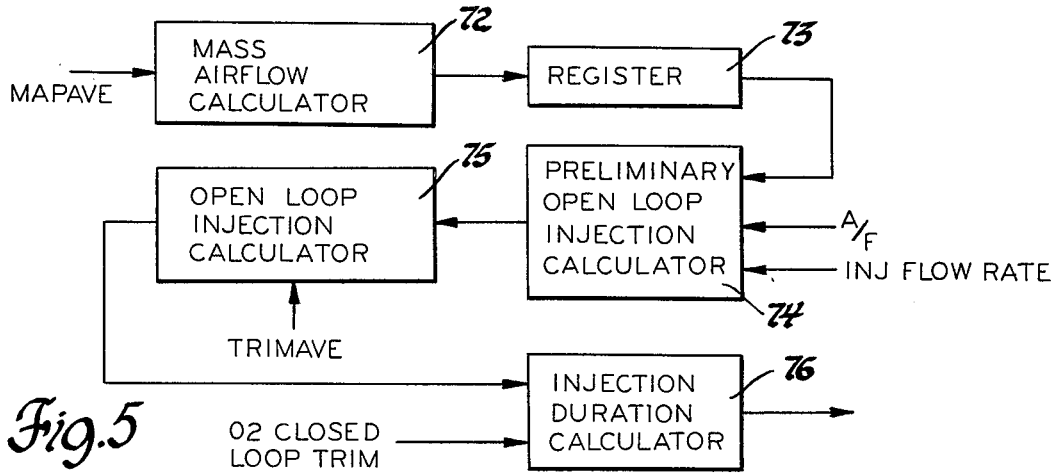
FIG. 5 shows the injection pulse calculator of FIG. 4 in block diagram form.

Referring to FIG. 5, the injection pulse calculator comprises a mass airflow calculator 72 which receives the MAPAVE signal and calculates an estimated mass airflow according to a predetermined functional relationship. This mass airflow is provided to a register 73 and from there to a preliminary open loop injection calculator 74, where it is divided by the air fuel ratio A/F to provide a desired fuel flow and by an injection flow rate factor to provide a preliminary injection duration. This is provided to an open loop injection calculator 75 where it is modified by the trimming factor TRIMAVE to generate the open loop injection duration. If the optional 02 closed loop trim is provided, it is combined with the open loop injection duration in an injection duration calculator 76, from which the final injection duration is provided to an injection control 78 of FIG. 4 for control of injectors 38 and 39.

In the case of a carburetor, the precise embodiment might differ slightly; but it would generally include some means for providing a preliminary open loop fuel calculation, means for modifying this by a trimming factor such as TRIM or TRIMAVE and optionally combining the open loop calculation with a closed loop trim to provide a final fuel control parameter. An exemplary carburetor embodiment is described hereafter in connection with FIGS. 11 and 12.

Figure 6:
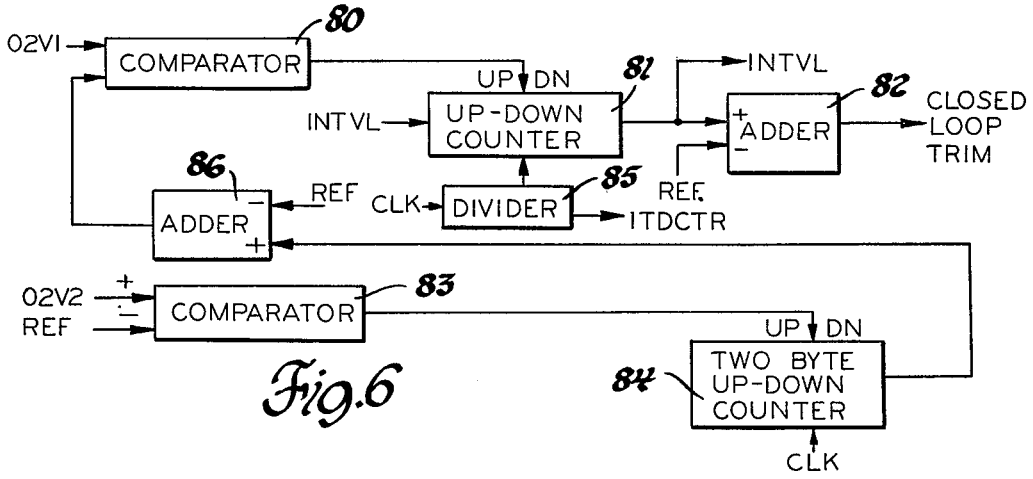
FIG. 6 shows the 02 closed loop trim of FIG. 4 in block diagram form.

Apparatus suitable for use as the 02 closed loop trim calculator 67 is shown in FIG. 6. Input 02V1 is compared in a comparator 80 with a reference derived in a manner to be described at a later point in this description; and the output controls the up-down input of an up-down counter 81. Up-down counter 81 acts as a digital integrator and provides, at any time, an output INTVL which may be referred to at later points in this description as the integrator value. This value INTVL is summed with a reference in an adder 82 to generate the closed loop trim factor.

A divider 85 supplies clock pulses to counter 81 at a rate slower than those supplied to the fuel control apparatus of FIG. 5 so that INTVL is updated only, e.g., every four fuel calculations. Divider 85 can take the form of a down counter, the count of which is provided for use elsewhere in the system and designated as ITDCTR.

The input 02V2 from register 54 is compared with a reference in a comparator 83 and the output is provided to the up-down input of a two byte up-down counter 84. As two byte up-down counter 84 is clocked, the high byte will change value only on each two hundred fifty sixth count in an up or down direction. This high byte is provided to an adder 86 to be summed with a reference; and the output of adder 86 is provided to comparator 80 as the previously cited reference. The reference supplied to adder 82 is the value of INTVL which corresponds to stoichiometry. The reference supplied to comparator 83 is the value of 02V2 which corresponds to stoichiometry. It is obvious that two byte up-down counter 84 will change its output at a far slower rate than up-down counter 81. Since two byte up-down counter 84 receives its signal from the downstream exhaust sensor 25, it will provide a reference which indicates slow drift of the average air/fuel ratio. Further details of this closed loop trim calculator and the two sensor method of providing an air/fuel ratio signal will be found in the Bowler et al reference and the U.S. Pat. No. 3,939,654 to Wendel D. Creps.

Figure 7:
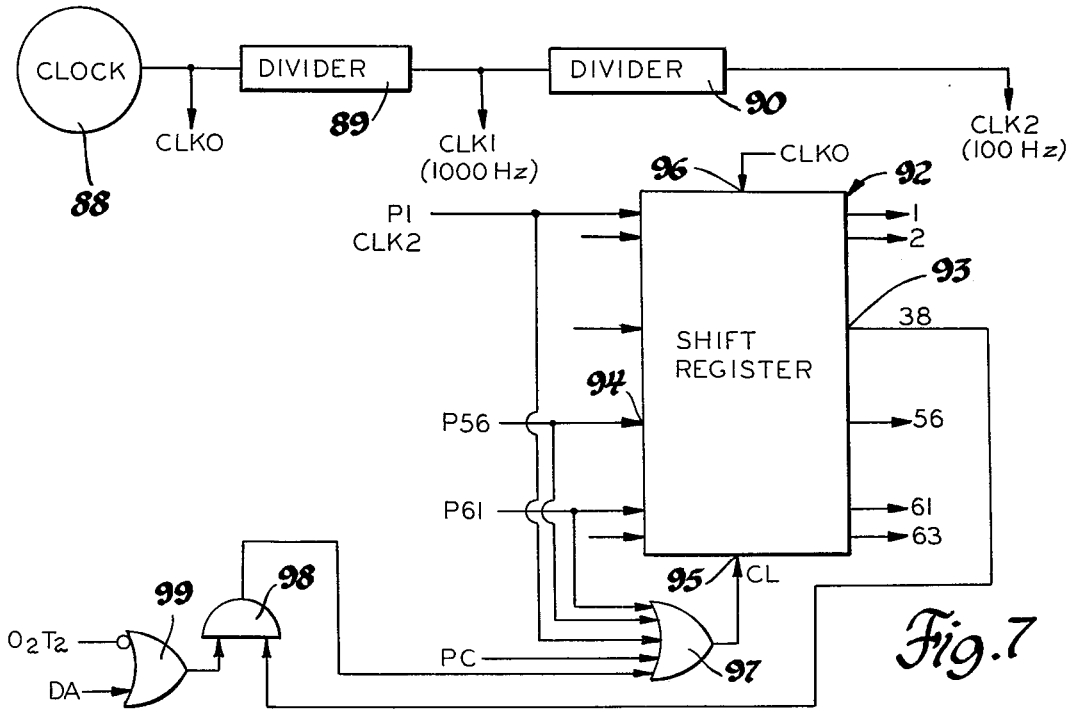
FIG. 7 shows a preferred embodiment of the clock and sequence control of FIG. 4.

A clock and sequence control for a preferred embodiment of this invention is shown in FIG. 7. A clock 88 generates high frequency square wave clock pulses CLK0. A divider 89 functions to divide the frequency of the clock pulse CLK0 to a lower frequency square wave CLK1 having a frequency of, for example, one kilohertz. A divider 90 functions to divide the frequency of clock pulses CLK1 still further to produce a square wave CLK2 having a frequency of 100 hertz in the preferred embodiment and consequently having a period of 10 milliseconds.

A shift register 92 has, in this embodiment, 63 bit positions with parallel input and output. Each of the positions has a corresponding output numbered 1, 2, etc. in FIG. 7; while only those inputs required for this embodiment, numbered P1, P56 and P61 need be provided. Shift register 92 has a clear gate 95 which functions to clear all bit positions to zero; in addition, it has a clock gate 96 provided with clock pulses CLK0, which are effective to shift a digital 1 through the bit positions in numerical sequence at the rate of one bit position for each clock pulse CLK0. A digital 1 can be loaded into shift register 92 through any of the inputs 94; and any bit position containing a digital 1 provides a digital 1 on its corresponding output. Thus, for example, a digital 1 can be loaded into shift register 92 on input P1 and will immediately generate a digital 1 output on output 1. It will then be advanced through the shift register, producing digital 1 outputs on output lines 2, 3, etc. until it is removed by a clear pulse on gate 95. If the digital 1 is allowed to proceed completely through the shift register to output 63, the sixty fourth clock pulse CLK0 will remove the bit from the shift register and no further outputs will be obtained from shift register 92 until another digital 1 is loaded in. Branch lines are provided from inputs P1, P56, and P61 through an OR gate 97 to clear gate 95; and shift register 92 is constructed in such a way that clear gate 95 will first clear the shift register and then accept a new input from one of the input lines. Thus, the supply of an input pulse on any of the input lines automatically clears shift register 92 of any digital 1 already in the shift register at that time.

Clock pulses CLK2 are applied to input P1 of shift register 92. Since the clock pulses CLK0 are much higher in frequency than pulses CLK2, there will be time for many more of them than 63 between each two consecutive clock pulses CLK2. Thus, clock pulses CLK2 can be considered triggers, which occur once every 10 milliseconds, to trigger a series of circuit functions or programs steps controlled in sequence from outputs 1–63 at the rate of clock pulses CLK0. The first 37 outputs of shift register 92 may be used to control the portions of the system already described to this point, that is, the entire fuel controller shown in FIG. 4 exclusive of the calibration learning control 71. The precise connections for outputs 1–37 could be designed by anyone skilled in the art; and the number of 37 outputs is chosen since that is the number of sequencing pulses used in the system shown in the aforementioned Bowler et al reference, which can serve as a typical example of such a system.

Since clock pulses CLK2 being a sequence on output 1 in shift register 92 every 10 milliseconds, the fuel supply calculation will be performed regularly at this rate. Output 38 of shift register 92 is provided, however, to test the desirability of proceding, after each of these calculations, to outputs 39–63, which control the calibration learning control 71. Output 38 is connected to one input of an AND gate 98 which has an output to OR gate 97. The other input of AND gate 98 is connected to the output of OR gate 99, which is provided with inputs from an inverter $0_2T_2$ temperature signal from register 56 and a disable signal from apparatus not shown. The inverted $0_2T_2$ signal provided to OR gate 99 is actually a modified form of signal $O_2T_2$ from register 56, which is first fed through a comparator and then inverted as shown to generate a digital 1 through OR gate 99 to the input of AND gate 98 when the temperature of downstream exhaust sensor 25 is too low to provide a reliable sensor signal therefrom. The disable input DA to OR gate 99 can be activated, at the designer's choice, by any engine condition or other factor which makes it undesirable for the calibration learning control to operate. A prime example is power enrichment during acceleration, since a stoichiometric fuel mixture is not desired at that time. The disable signal DA is further discussed in the aforementioned Bowler et al reference. An additional input to OR gate 97 is labeled PC, the function of which will be apparent in the following description of FIG. 8.

Figure 8:
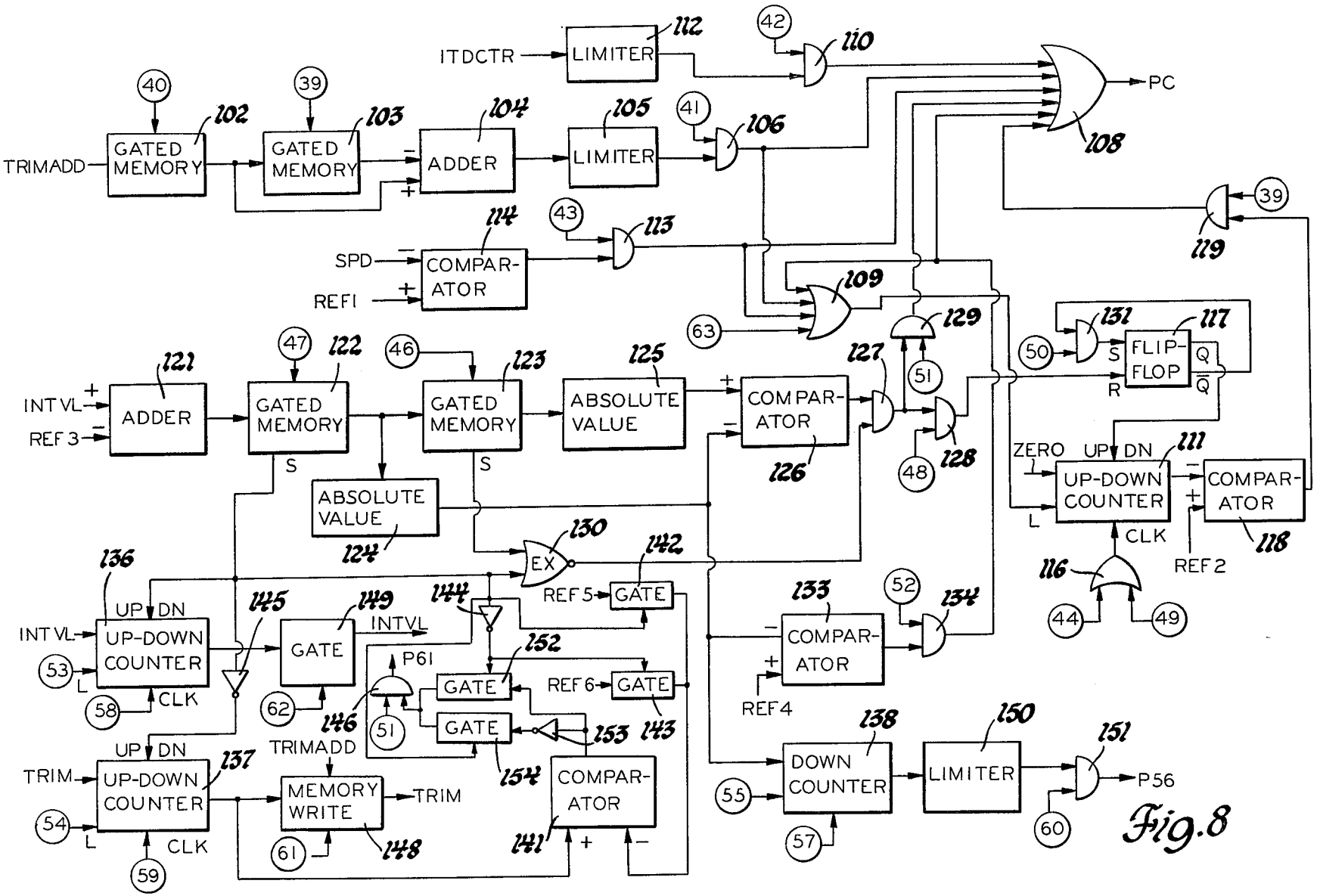
FIG. 8 shows a preferred embodiment of the calibration learning control of the system of FIG. 4 for use with clock and sequence control of FIG. 7.

FIG. 8 shows a preferred embodiment of calibration learning control 71. In FIG. 8, certain circled numbers, from 39–63, refer to connections to outputs 39–63 of shift register 92 in FIG. 7. Each of these connections normally carry a digital zero but is provided with a digital one sequence pulse when a digital one is in the corresponding bit location in a shift register 92. FIG. 8 also shows a number of outputs entitled P56, P61 and PC, which are understood to be connected to the correspondingly labeled inputs in FIG. 7.

Referring to FIG. 8, a gated memory 102, which can be, for example, a register, has an input of TRIMADD from the address decoder 60 and an output to a gated memory 103 and an adder 104. Gated memory 103 also has an output to adder 104 so that adder 104 provides the difference of the numbers stored in gated memories 102 and 103 to a limiter 105 which limits said difference to a positive one. The output of limiter 105 is provided to one input of an AND gate 106, the output of which is provided to an OR gate 108 having an output PC, already described, and to an OR gate 109 having an output to the load trigger L of an up-down counter 111.

In operation, sequence pulse 39 causes gated memory 103 to read and store the contents of gated memory 102, which is the address TRIMADD in the memory 61 of the trimming factor computed during the last previous fuel supply calculation. Sequence pulse 40 causes gated memory 102 to then read the new trimming factor address TRIMADD from address decoder 60; and the difference between the present and previous addresses, if any, is limited to plus one in limiter 105 and supplied to AND gate 106. If there is no difference, a zero will be supplied to AND gate 106 from limiter 105. Sequence pulse 41 provides a digital one pulse to the other input of AND gate 106 which, if the one is present on AND gate 106 from limiter 105, causes up-down counter 111 to be loaded with zero and, through input PC, causes shift register 92 to be cleared.

If the output of limiter 105 is zero at the time of sequencing pulse 41, the output of AND gate 106 will remain zero and a sequencing pulse 42 will next be produced by shift register 92. Sequencing pulse 42 is provided to one input of an AND gate 110 having an output to OR gate 108 and another input from a limiter 112 which is provided with the number ITDCTR from divider 85 of FIG. 6. If the number ITDCTR is anything other than zero, which means that INTVL has not been updated, limiter 112 will produce a one input and sequencing pulse 42 will cause a clear of shift register 92 by means of input PC; however, the count of up-down counter 111 will not be affected.

Sequencing pulse 43 is provided to an AND gate 113, which is also provided with the output of a comparator 114 connected to compare the engine speed signal SPD from speed calculator 58 with a reference REF1. REF1 is chosen so that normal engine speeds greater than engine cranking speed will produce a zero output from comparator 114. A one output from comparator 114 indicates engine starting or cranking and, if present simultaneously with sequencing pulse 43, will cause up-down counter 111 to be reset to zero and shift register 92 to be cleared through input PC.

If shift register 92 has not been cleared by sequencing inputs 41, 42 or 43, sequencing pulse 44 is provided through an OR gate 116 to the clock input of up-down counter 111. The up-down input of up-down counter 111 is controlled by a flip-flop 117 and is normally in the up count position. Thus, sequence pulse 44 causes up-down counter 111 to count up one count; and the new count is compared in a comparator 118 with a reference REF2. When the count of up-down counter 111 is less than REF2, the output of comparator 118 is zero; but when it becomes greater than REF2 the output of comparator 118 becomes one. The output of comparator 118 is provided to an AND gate 119 along with sequence pulse 45 to cause a clearing of the shift register 92 through input PC if the count of up-down counter 111 is less than REF2.

The apparatus of FIG. 8 described to this point basically compares the memory address TRIMADD, corresponding to one or more engine operating variables, over a consecutive number of time intervals of 10 milliseconds. Only when the address TRIMADD remains the same for a number of consecutive intervals determined by REF2 does the apparatus move beyond sequence pulse 45. REF2 is chosen such that the number of consecutive intervals of 10 milliseconds is at least equal to the transport delay of engine 11. Thus, sequence pulses 39–45 basically determine the constant existence of a particular engine operating variable for a period of time at least equal to the transport delay.

An adder 121 is provided with the integrator value INTVL from up-down counter 81 in $0_2$ closed loop trim 67 on its positive input and a reference REF3 on its negative input. The output of adder 121 is provided to a gated memory 122, the output of which is provided to another gated memory 123 and an absolute value calculator 124. The output of gated memory 123 is provided to an absolute value calculator 125, the output of which is connected to the positive input of a comparator 126. The negative input of comparator 126 is connected to the output of absolute value calculator 124; and the output of comparator 126 is provided to one input of an AND gate 127, the output of which is connected to inputs of AND gates 128 and 129. The output of AND gate 128 is connected to the reset input of flip-flop 117; while the output of AND gate 129 is connected to an input of OR gate 108. The sign outputs of gated memories 122 and 123, which, in the case of a register, could be the sign bit outputs, are connected to inputs of an exclusive NOR gate 130, the output of which is connected to an input of AND gate 127.

In operation, adder 121 computes the error between the integrator value INTVL and REF3, the latter being the desired integrator value for stoichiometric operation. The output of adder 121 is thus seen to be the same as the output of adder 82 in FIG. 6 and represents the error in the time integrated value of the sensor signal. Sequencing pulse 46 causes gated memory 123 to read and store the contents of gated memory 122, which contains the last previously computed error from adder 121. Sequencing pulse 47 then causes gated memory 122 to read and store the new computed error from adder 121. The absolute values of the old and new errors are computed and provided to comparator 126. If the absolute value of the new error is less than the absolute value of the old error, a one output will be provided from comparator 126 to AND gate 127.

In addition, sign bits of the numbers stored in gated memories 122 and 123 produce a one output from exclusive NOR gate 130 to AND gate 127 when they are equal. Thus, if the new error has the same sign as the old and is less than the old error, which indicates that the error is progressing toward zero, AND gate 127 will produce a one output. Sequencing pulse 48 is provided to AND gate 128 to produce a one or high output therefrom if the output of AND gate 127 is high and cause flip-flop 117 to change up-down counter 111 to its down counting condition. Sequencing pulse 49 is provided through OR gate 116 to clock up-down counter 111 and cause it to count down one count. Sequencing pulse 50 is provided to an AND gate 131 which also receives the reset output of flip-flop 117 and has an output connected to the set input of flip-flop 117. Thus, sequencing pulse 50 causes flip-flop 117 to return up-down counter 111 to its up counting condition. Sequencing pulse 51 is provided to AND gate 129 which generates a high output when the output of AND gate 127 is high to clear shift register 92 through input PC.

To summarize the operation of these elements, sequencing pulses 46 and 47 cause the storage of an old error and new error of the integrator value INTVL, while sequencing pulses 48–51 provide a delay in learning or recalibration of the trimming factor while the error is moving toward zero. This last feature, although not absolutely necessary, is desirable, since there is not much point in recalibrating the trimming factor for a particular value of the engine operating condition or conditions if the integrated value of the sensor signal has been moving toward the desired value as a result of the present trimming factor corresponding to that value of the engine operating variable or variables. It may be that the present trimming factor is correct, and that the error in the integrator value is due to some previous engine operation variable and is only still present, although decreasing, due to the time delay effects of the integrator or other factors. However, when the signs of the old error and new error are different, which indicates that the error has passed through zero, or when the new error is greater than the old error, which means that the integrator value is diverging from the desired value, it is desired to progress to the actual recalibration of the trimming factor. Thus, AND gate 127 produces a zero output and sequencing pulses 48–51 produce no important effects in the apparatus, other than an additional up count in counter 111 due to sequencing pulse 49, which can be disregarded since the count of up-down counter 111 plays no role in the steps initiated by sequencing pulses 52–63.

The output of absolute value calculator 124 is provided to the negative input of comparator 133 having a positive input provided with a reference REF4 and an output connected to an input of an AND gate 134. Comparator 133 compares the absolute value of the new error from gated memory 122 with a number REF4 which established a dead band of, e.g., two percent, for the stability of the system. If the absolute value of the error is zero or some small number less than REF4, the output of comparator 133 will be one or high and the sequencing pulse 52 provided the other input of AND gate 134 will cause a one or high output from AND gate 134 to OR gates 108 and 109 to load zero in up-down counter 111 and clear shift register 92 through input PC. The reason for comparator 133 and sequencing pulse 52 is that there is obviously no need to recalibrate the trimming factor if the integrator value INTVL indicates stoichiometry. The dead band is provided to prevent hunting around the desired value of INTVL.

For the actual recalibration of the trimming factor TRIM, three counters are provided: an up-down counter 136, an up-down counter 137 and a down counter 138. Up-down counter 136 has an input connected to up-down counter 81 of $0_2$ closed loop trim calculator 67 so that up-down counter 136 is loaded with the integrator value INTVL upon the application of a sequencing pulse 53 to a load input. Up-down counter 137 has an input connected to memory read-write apparatus 62 so that it will be loaded with the trimming factor TRIM upon the application of a sequencing pulse 54 to a loading input. Down counter 138 has an input connected to absolute value calculator 124 so that it will be loaded with the absolute value of the new error in INTVL when a sequencing pulse 55 is applied to a load input.

In basic operation, down counter 138 is used as a reference counter for modifying the value of TRIM in counter 137 and the value of INTVL in counter 136 by the amount of the error in INTVL. To this end, the output of up-down counter 137 is connected to the positive input of a comparator 141. The purpose of comparator 141 is to compare the value of TRIM already in up-down counter 137 with the upper or lower limit of this number imposed by RAM 61. Assuming that the number TRIM is a positive number, either one of a reference REF5, which is the lower limit of TRIM and a reference REF6, which is the upper limit of TRIM, are provided to the negative input of comparator 141 through gates 142 or 143, respectively. The sign output of gated memory 122 is connected to gate 142 directly and through an inverter 144 to gate 143 to control the application of REF5 and REF6 to comparator 141. The sign output of gated memory 122 is also connected to the up-down inputs of counters 136 and 137, the latter through an inverter 145. When the error of the integrator value INTVL, as stored in gated memory 122 is positive, resulting in a sign bit of zero, counter 136 is set to count down, counter 137 is set to count up and gate 143 is actuated to supply REF6 to comparator 141. A negative number in gated memory 122, however, sets counters 136 and 137 to count up and down, respectively, and actuates gate 142 to supply REF5 to comparator 141.

The output of comparator 141 is connected through a gate 152 and also through an inverter 153 and a gate 154 to one input of an AND gate 146 with an output P61 to shift register 92. The sign output of gated memory 122 is connected directly to actuate gate 154 and through inverter 144 to actuate gate 152. The result is that, whichever way counter 137 is counting, when the limit of TRIM is reached, sequencing pulse 56, applied to the other input of AND gate 146, will send shift register 92 directly to sequencing pulse 61, which is applied to a memory write portion 148 of memory read-write apparatus 62 to replace the value of TRIM in RAM 61 at the address TRIMADD with the value of TRIM in up-down counter 137. Sequencing pulse 62 is applied to a gate 149 to gate the value of INTVL in up-down counter 136 into up-down counter 81 of 02 closed loop trim calculator 67. Sequencing pulse 63, finally, is applied to OR gate 109 to clear up-down counter 111 to zero before shift register 92 is cleared.

Assuming that the limit of TRIM is not indicated by comparator 141, sequencing pulse 57 is applied to the clock input of down counter 138 to count the count down one. Sequencing pulses 58 and 59 are likewise applied to the clock inputs of counters 136 and 137, respectively, to count these counters one count in the directions determined by the sign bit of gated memory 122 as previously described. The output of down counter 138 is limited to one by a limiter 150, the output of which is provided to one input of an AND gate 151 with an output connected to input P56 of shift register 92. Sequencing pulse 60 is provided to the other input of AND gate 151 to cause a return of shift register 92 to output 56 unless the number in down counter 138 is zero.

Thus, sequencing pulses 56 through 60 form a subloop or subroutine which counts the down counter 138 down one count at a time, with corresponding counts in appropriate directions for counters 136 and 137, until down counter 138 reaches zero or comparator 141 indicates a limit to the value of TRIM in up-down counter 137, whereupon the shift register proceeds to sequencing pulses 61–63 to write the new values of TRIM and INTVL in the appropriate apparatus and clear the up-down counter 111 for the next timing pulse CLK2. Although many timing pulses CLK2 may have been required before shift register 92 reached sequencing pulse 52 to begin the recalibration process, all further activities up through the clearing of up-down counter 111 by sequencing pulse 63 occur, at the rate of CLK0, before the next clock pulse CLK2.

Up-down counter 136, as previously described, is used to adjust the integrator value INTVL of up-down counter 81 at the same time that the trimming factor TRIM is adjusted, and, in this embodiment, by substantially the same amount. Although it is possible for the system to work without this function, overshoot in the correction of the trimming factor TRIM will probably result due to the delaying effect of time integration as performed by up-down counter 81 after the trimming factor TRIM has been changed. The correction of INTVL simultaneously with the correction of TRIM disposes of this time delay effect so that INTVL tracks TRIM during the correction and up-down counter 81 does not need to count its way back to the desired value. It may, of course, immediately begin counting toward some other value; but it will probably be closer to that value than it would have been had the change in INTVL not been made.

The embodiment of this invention shown in FIGS. 7 and 8 is intended to be the equivalent of a general purpose digital computer programmed to function in approximately the same manner. The individual blocks shown in FIGS. 7 and 8 correspond in greater or lesser degree to actual digital computer apparatus such as registers, logic elements, counters and so forth. Shift register 92 is equivalent to a program counter producing a series of instructions corresponding to sequencing pulses 1–63. It would certainly be obvious to one skilled in the art to write a program for a particular digital machine which would transform that machine into the equivalent of the apparatus shown here.

Figure 9:
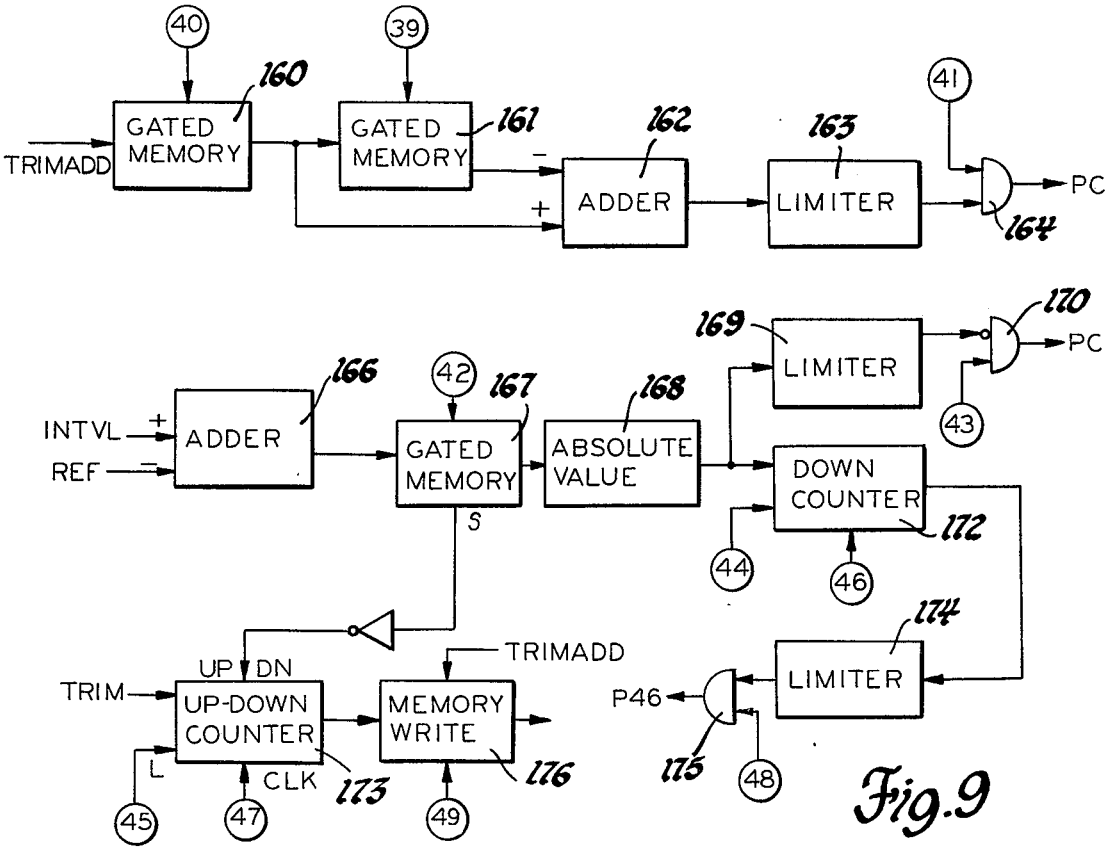
FIG. 9 shows an alternate embodiment of the calibration learning control of the system of FIG. 4.
Figure 10:
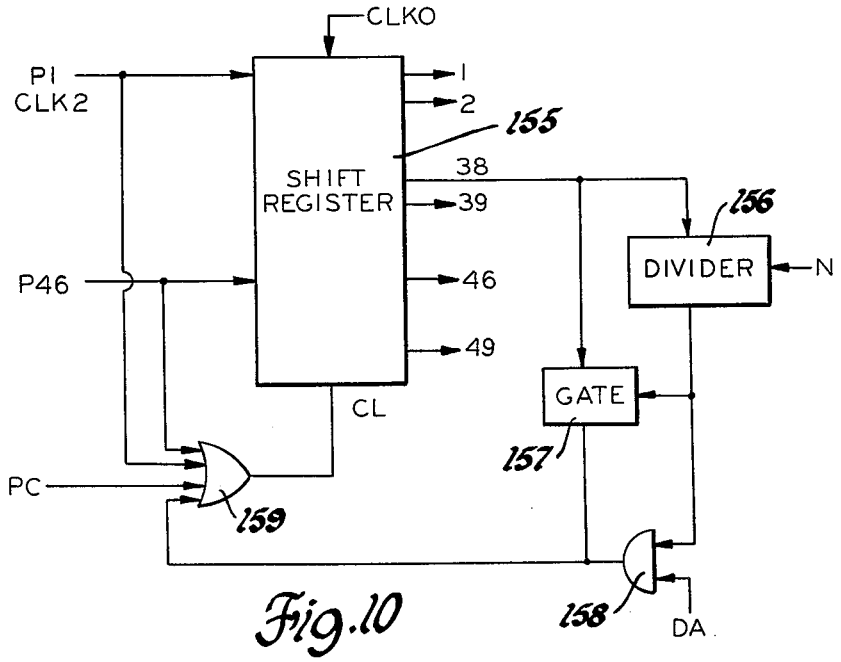
FIG. 10 shows an alternate embodiment of the clock sequence control of the system of FIG. 4, for use with the embodiment of FIG. 9.

Another, simplified, embodiment of this invention is shown in FIGS. 9 and 10. Referring first to FIG. 10, a shift register 155, generally similar to shift register 92, has a clock input supplied with pulses CLK0, a loading input P1 supplied with clock pulses CLK2, a loading input P46, outputs 1–49 and a clear input CL. Output 38 is provided through a normally activated gate 157 to an OR gate 159. Output 38 is also supplied to a divider 156, the output of which is connected to gate 157 and one input of an AND gate 158, the other input of which receives a disable signal DA and the output of which is connected through OR gate 159 to a clear input of shift register 155. Inputs P1 and P46 of shift register 155 are also connected through OR gate 159 to the clear input as is an input PC to OR gate 159. Output 38 is divided by N in divider 156 so that an output pulse is supplied, for every N output pulses 38, to gate 157 to deactivate it and prevent the passage of output pulse 38 therethrough. With the exception of gate 157 and divider 156, the apparatus of FIG. 10 is similar to that of FIG. 7 and uses the same clock pulses shown in FIG. 7. Further discussion of divider 156 and gate 157 will be undertaken in description of FIG. 9.

In FIG. 9, a gated memory 160 receives TRIMADD from address decoder 60 and has an output connected to the input of a gated memory 161 and also to an adder 162. The output of gated memory 161 is connected to adder 162 so that the output of adder 162 is the difference between the numbers stored in gated memories 160 and 161. This difference is provided through a limiter 163, which limits it to positive one, to one input of an AND gate 164, the output of which is supplied to input PC of shift register 155. Sequencing pulse 39, applied to gated memory 161, causes it to read and store the contents of gated memory 160. Sequencing pulse 40, applied to gated memory 160, causes it to read and store the new TRIMADD term from address decoder 60. Thus, the output of limiter 163 is zero if the new and old TRIMADD terms are the same and is one if the new and old TRIMADD terms are different. Sequencing pulse 41 is applied to the other input of AND gate 164 to clear shift register 155 if the new and old TRIMADD terms are different.

The number N of divider 156 in FIG. 10 is chosen to produce a longer comparison integral between new and old TRIMADD terms than the 10 millisecond interval of clock pulses CLK2. In this embodiment it is desired that the TRIMADD term, which represents a particular value of an engine operating variable or set of engine operating variables be regularly sampled at an interval at least equal to the transport delay of engine 11. Although there is a slightly greater chance that the TRIMADD term might have changed during the interval then if a number of checks are made at the CLK2 rate, it is still likely, in view of the dynamics of engine operation, that, if the TRIMADD term is the same as the end of a transport delay interval as it was at the beginning of that interval, it did not change significantly during that interval. The number N in divider 156, then, is chosen so that shift register 155 proceeds to sequencing pulse 39 at intervals separated at least by the transport delay of engine 11. Of course, the number N could be preset for a maximum expected transport delay or it could be changed continuously as a function of one or more engine operating variables to more closely represent the actual transport delay. In addition, the disable signal DA could cancel even these less frequent pulses.

If the present and former TRIMADD terms are the same, recalibration of the trimming factor is undertaken. The integrator value INTVL is summed with a reference in an adder 166, the output of which is provided to gated memory 167 upon the application of a sequencing pulse 42. Absolute value calculator 168 provides the absolute value of the contents of gated memory 167 through a limiter 169, which limits the absolute value to one, and an inverting input to an AND gate 170, which has an output to input PC of shift register 155 and another input provided with sequencing pulse 43. Sequencing pulse 43 causes a clearing of shift register 155 if the error between INTVL and the reference is zero.

The output of absolute value calculator 168 is also loaded into a down counter 172 upon the application of a sequencing pulse 44; and the TRIM term from RAM 61 is loaded into an up-down counter 173 upon the application of the sequencing pulse 45. The output of down counter 172 is connected through a limiter 174, which limits it to one, to one input of an AND gate 175 having an output connected to input P46 of shift register 155. The output of up-down counter 173 is connected to a memory write portion 176 of memory read-write apparatus 62. Sequencing pulse 46 is applied to down counter 172 to cause it to count down one count; sequencing pulse 47 is applied to the clock input of up-down counter 173 to cause it to count one count in the direction determined by its up-down input, which is connected through an inverter to the sign output of gated memory 167; and sequencing pulse 48 is applied to the other input of AND gate 175 to return the shift register to position 46 if the count in down counter 172 is not zero.

When the count in down counter 172 reaches zero, sequencing pulse 49, applied to memory write portion 176, causes the entry of a new TRIM term in RAM 61 at the address specified by TRIMADD from address decoder 60. It can be seen that the operation of the apparatus of FIG. 9 is similar to the operation of those portions of FIG. 8 which are analogous.

Figure 11:
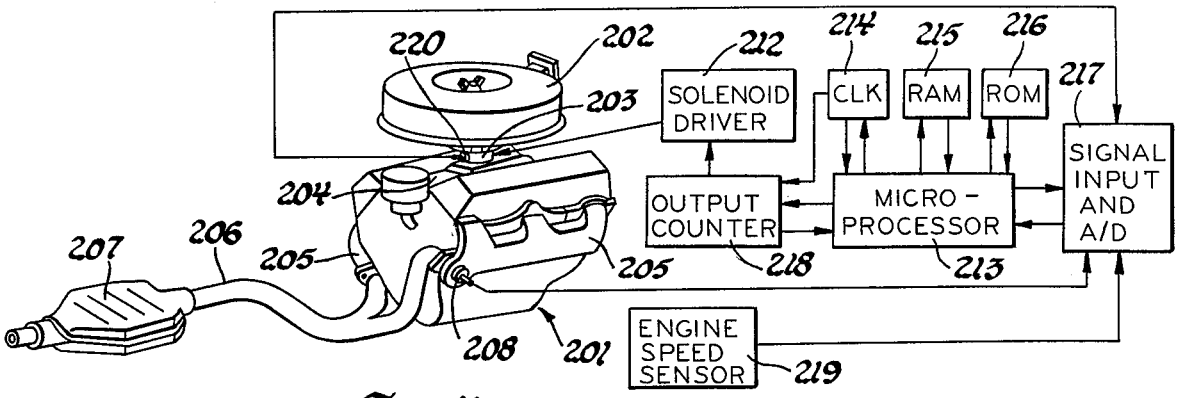
FIG. 11 is a view, partially in perspective and partially in block diagram form, of a carburetor embodiment of this invention.
Figure 12:
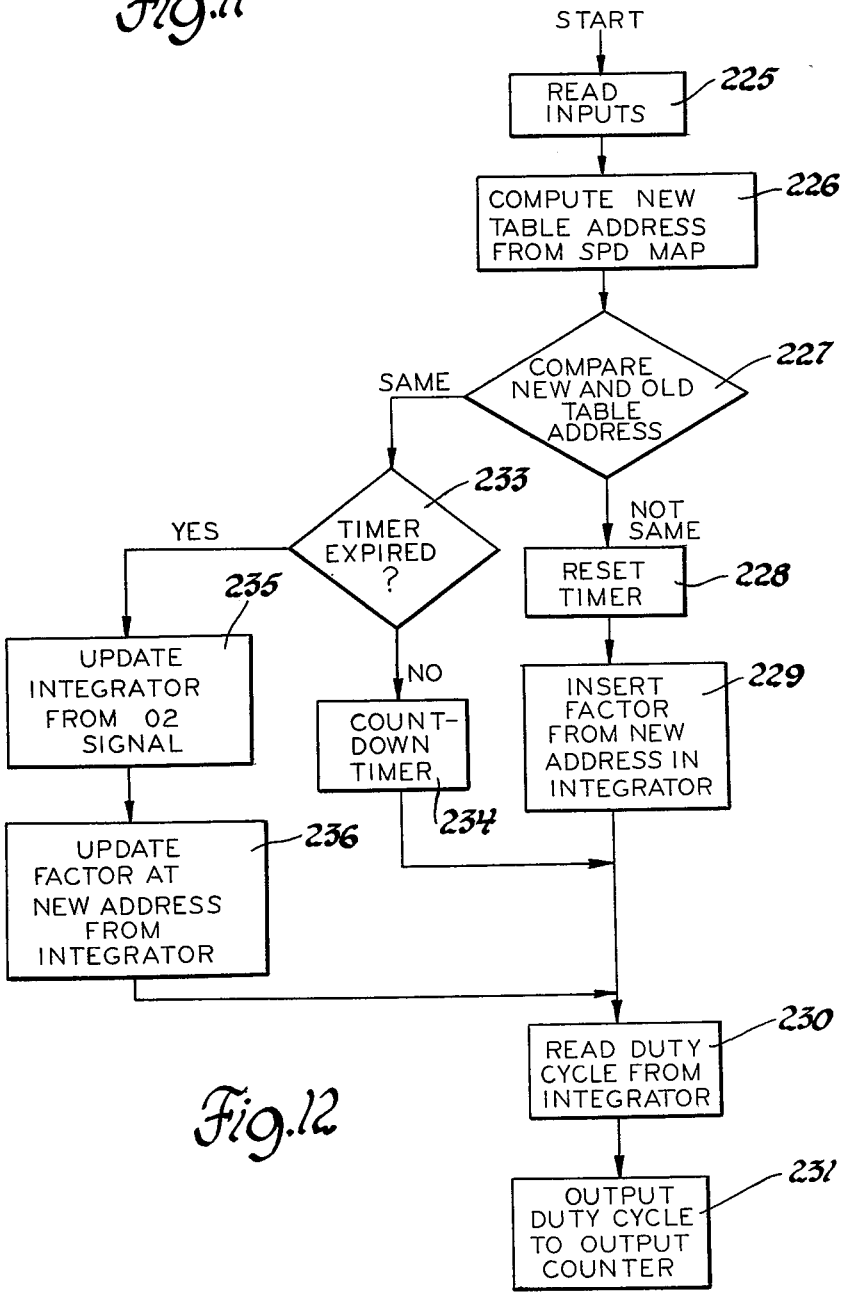
FIG. 12 is a computer flowchart showing the operation of the embodiment of FIG. 11.

FIGS. 11 and 12 are directed to an embodiment of the present invention for use with a carburetor and suitable for installation on a variety of motor vehicles with the control parameters keyed to the differing requirements of the vehicles. As shown, in FIG. 11, the engine 201 is provided with an air cleaner 202, through which air passes into carburetor 203. From carburetor 203 the air, with entrained fuel, passes into the engine intake manifold 204. After passing through the engine cylinders, and being burned, the air/fuel mixture passes to the exhaust manifold 205, which, as illustrated with a V-type engine, is in two parts, one being on each side of the engine. The mixture then goes to exhaust conduit 206 from which it passes to the catalytic converter 207. Oxygen sensor 208 in this construction is located at the discharge end of the exhaust manifold 205 on one side of the engine. It thus is exposed to the condition of the carburetor fuel/air mixture after the time delay associated with passage of such mixture through the carburetor, intake manifold, engine and exhaust manifold.

Figure 13:
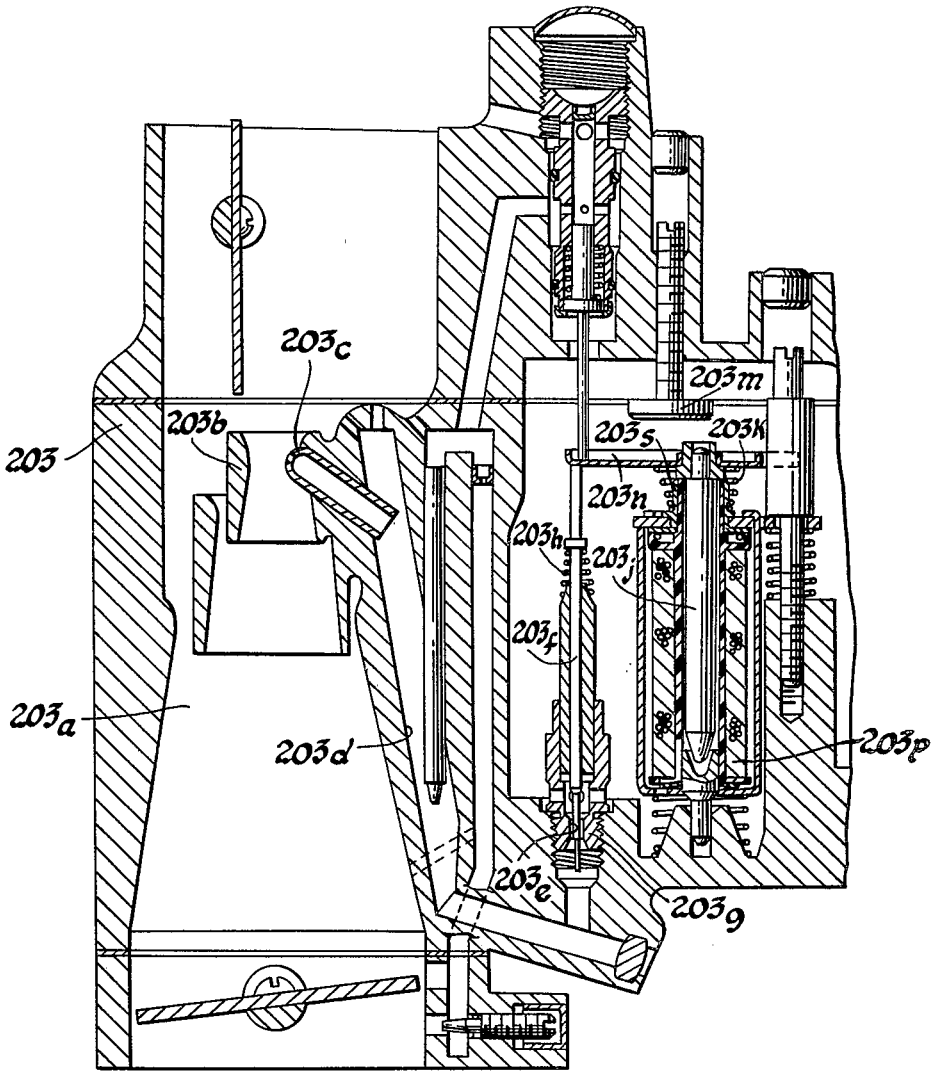
FIGS. 13 and 14 are axial schematic views of a carburetor for use with the embodiment of FIG. 11.
Figure 14:
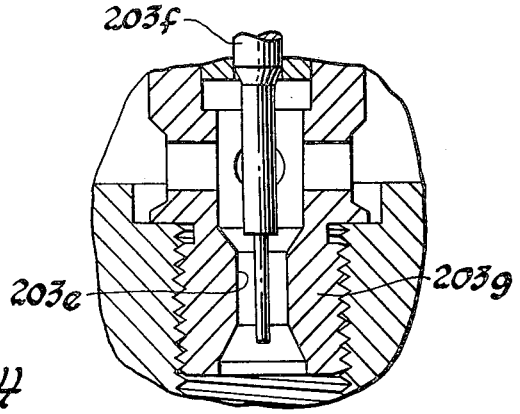

FIG. 13 is a schematic axial view of an illustrative carburetor suitable for use with the apparatus of FIGS. 11 and 12. As shown, the carburetor includes a main air induction passage 203*a* with a venturi portion having a venturi cluster unit 203*b* into which fuel nozzle 203*c* communicates. Fuel enters nozzle 203*c* from main fuel passage 203*d* which, in turn, receives fuel through metering passage 203*e*. The resistance to fuel flow through passage 203*e* depends upon the vertical position of metering rod 203*f*, which is controlled by the apparatus of FIG. 11 as hereinafter described. The amount of such fuel further depends on the mass flow rate of the intake air passing through the carburetor air induction passage 203*a* in accordance with carburetor action. That is, at any position of the metering rod 203*f*, a predetermined mixture of fuel and air is produced over a range of mass airflow into the engine. In the illustrated carburetor of FIG. 13, the metering rod 203*f* moves between a lower, relatively lean mixture position, shown in FIG. 13 and an elevated relatively rich mixture position as shown in FIG. 14. In the former position, the metering rod 203*f* defines, with insert 203*g*, a metering passage 203*e* of relatively small cross-sectional area and hence a relatively great resistance to fuel flow into the main fuel passage 203*d*. In the latter, elevated position shown in FIG. 14, the metering rod 203*f* defines a metering passage 203*e* of relatively greater cross-sectional area with a resulting lower flow resistance to fuel flow into the main fuel passage 203*d*.

The metering rod 203*f* is moved between the lower position of FIG. 13 and the elevated position of FIG. 14 by the coaction of springs 203*h* and 203*k*, solenoid armature 203*j* with attached bracket 203*n* and solenoid coil 230*p*. Spring 203*k* tends to raise armature 203*j* and bracket 203*n* upward; and spring 203*h* causes metering rod 203*f* to follow bracket 203*n* upward. However, a predetermined current flow in coil 203*p* pulls armature 203*j*, and thus bracket 203*n* and metering rod 203*f*, downward against springs 203*k* and 203*h*. Upper and lower stops 203*m* and 203*s*, respectively, are provided for armature 203*j* to limit said movement.

Other controls embodied in the carburetor illustrated in FIGS. 13 and 14 are described in the copending application Ser. No. 916,783, filed June 19, 1978 by Robert L. Hogeman, Jack L. Seaman and Roland S. Taylor, assigned to the same assignee as the present invention.

Current flow is applied to coil 203*p* by the solenoid driver 212, FIG. 11. This driver includes a suitable control circuit, preferably a Darlington transistor pair, that is switched between full conduction and substantial non-conduction so that the current flow in coil 203*p* tends to be substantially zero or substantially the maximum value at any instant of time. To this end, the driver includes circuitry which responds to the pulse duration modulated wave produced by an output counter 218, as hereinafter described. The overall effect of the time constant of the solenoid, armature, and fluid system causes the effective resistance to fluid flow into the main metering passage 203*d* to be in substantial accordance with the duty cycle of the pulse duration modulated wave, so that there is a continuous modulation of the flow rate of fuel into the intake air in accordance with such duty cycle.

Solenoid driver 212 is controlled by a control system comprising a microprocessor 213, clock 214, RAM 215, ROM 216, signal input and analog-to-digital conversion apparatus 217, output counter 218, engine speed sensor 219 and manifold absolute pressure sensor 220, as well as oxygen sensor 208. As described hereafter, microprocessor 213, clock 214, RAM 215, ROM 216, signal input apparatus 217 and output counter 218 coact to generate a pulse width modulated signal that properly trims or modulates the effective air/fuel mixture entering the engine. These elements are, as described below, digital computer elements such as Motorola 6800 series units.

In one embodiment of the apparatus of FIGS. 11–14, the pulse width modulated signal from output counter 218 has a period of 100 milliseconds, that is, a repetition rate of 10 per second. The duration of each pulse is calculated periodically, such as once every 100 milliseconds, and stored on a register (not shown) in output counter 218. The pulse width modulated signal is generated in output counter 218 in response to the number stored on this register. Clock 214 provides output pulses at a number of different but synchronized rates to time this action as well as the operations of the computing system. The latter executes, periodically, the program recorded on ROM 216, which serves as a program memory and causes execution of a complete computer major loop cycle at least once every 100 milliseconds. The program causes the information from oxgyen sensor 208, engine speed sensor 219 and manifold pressure sensor 220, as well as any other sensed conditions, to be periodically entered on suitable registers in input apparatus 217. Such entry occurs at least once per 100 milliseconds and, preferably, more frequently, through minor loops executed by the computer. For example, it is preferable to read the oxygen sensor once every 25 milliseconds, and to generate a number during each 100 millisecond period based on the values of the four preceding readings. Similarly, the engine speed and manifold absolute pressure sensors are preferably read every 12.5 milliseconds, with the most recent value used for control purposes every 100 milliseconds.

RAM 215 is a random access memory with memory locations each corresponding to a predetermined range of engine speeds and engine load factors with sufficient combinations to provide effective fuel/air trimming action in accordance with the principles of the present invention. In the illustrated apparatus, a total of sixteen such combinations of speed and load factor conditions is provided for, as by a 4-by-4 memory array. To illustrate, in one application, four engine speed ranges of 0–800, 800–1200, 1200–1800 and over 1800 are used, and the engine load factors are MAP values of 0–40, 40–50, 50–75 and over 75 kilopascals absolute, so that at each actual operating combination of engine speed and MAP a particular one of sixteen stored trimming factor numbers is available in RAM 215. Of course, another engine load indicating factor such as manifold vacuum or throttle position could be used in place of MAP, with the proper sensor provided.

The operation of the apparatus of FIG. 11 is described with reference to FIG. 12, which contains a computer flowchart descriptive of that operation and from which a programmer could write a program in a language specific to any commercially available computer or microprocessor.

In the operation of the control of FIG. 11, a major loop, as described by FIG. 12, is triggered by clock 214 every 100 milliseconds. Microprocessor 213 first executes subroutines, indicated as 225, to read the latest values of engine speed (SPD) and load (MAP), as well as the number generated from the oxygen sensor output (02) into appropriate storage registers within microprocessor 213 or RAM 215 from input apparatus 217.

From SPD and MAP, microprocessor 213, in subroutine 226, then determines a new table address according to the stored operating ranges for the trimming factor table of RAM 215.

The next subroutine 227 provides for comparison of the new table address with the old table address, the old table address being the new table address from the last computer cycle, which has been retained in a register or memory location. Methods for such comparison are well known in the computer programming art. After the comparison is made, the old table address may be discarded and the new table address inserted in the appropriate register or memory location for use as the old table address in the next computer cycle.

If the new and old table addresses are not the same, a transport delay timer is reset according to subroutines numbered 228. It is convenient to use the microprocessor 213 itself as a timer by inserting a transport delay number in a memory location or register and subsequently decrementing that number by a fixed amount on each subsequent computer cycle. The transport delay number inserted on a reset is a number which represents the number of computer cycles required to equal the transport delay time of engine 201.

In the embodiment of FIGS. 11–14, the engine transport delay number is retrieved from ROM 216, which contains sixteen memory locations corresponding to the sixteen memory locations of the trimming factor table of RAM 215. That is, the recorded engine transport delay times are like in number and in engine operating value ranges with the trimming factor values. The actual recorded times depend on the engine, the location of sensor 208 (which may vary from that shown in FIG. 11) and other factors. For example, in a passenger car using a 3.8 liter V-6 engine, the following engine transport delay times are recorded in the ROM 216 (expressed herein sedonds for convenience),

| MAP (kpa) | 800 | 1200 | 1800 |
|---|---|---|---|
| 75 | 0.3 | 0.2 | 0.2 | 0.2 |
| 50 | 0.4 | 0.3 | 0.3 | 0.3 |
| 40 | 0.4 | 0.3 | 0.3 | 0.4 |
| | 0.5 | 0.2 | 0.2 | 0.2 |

SPD (RPM)

In another passenger car system, using a 301 cubic inch V-8 engine, the following engine transport delay times are recorded in ROM 216 (once again, expressed in seconds):

| manifold vacuum (kpa) | 700 | 1100 | 1500 |
|---|---|---|---|
| 25 | 2 | 1 | .7 | .5 |
| 40 | 2 | 1 | .7 | .5 |
| 65 | 2 | 1 | .7 | .5 |
| | 2 | 1 | .7 | .5 |

SPD (RPM)

The latter example shows no variation with the load factor. As illustrated by the above charts, the actual different transport delay times may be less in number than the capacity of the ROM 216, which is an apparatus designed for utilization in many engines and provides greater capacity than is needed for some.

After the timer is reset, the trimming factor number from the new address in RAM 215 is inserted in a register. The trimming factor at the new address is used as an initialization factor in the new engine operating condition range and is inserted directly into the register in place of the number which previously existed therein. The subroutine for accomplishing this is numbered 229 in FIG. 12.

Subroutine 231 of FIG. 12 is that required by a particular microprocessor 213 to cause output of the duty cycle number in the register and insertion of that number in the output counter 218 for determination of the duty cycle thereof as previously described.

Returning to subroutine 227, if the new and old table addresses are the same, the timer is checked for expiration. In actual practice, this may be accomplished by a subroutine, numbered 233 in FIG. 12, which determines whether or not the contents of the timer register is 0. If it is not, the timer has not expired; and the timer register is decremented by 1 in a countdown operation identified as 234 in FIG. 12. At this point the computer may proceed to subroutine 230 and read the duty cycle number from the register once again.

It can be seen from the description to this point that, when the engine first enters a new range of engine operating condition as defined by the trimming factor table of RAM 215, the register is reset to a value determined by the trimming factor corresponding to that particular engine operating condition range and held constant for a time at least equal to the engine transport delay or until yet another new range is entered. There is no reference to the oxygen sensor output until the table address has been unchanged for a time at least as long as the transport delay. In the period immediately after a change to a new engine operating condition range, a correctly chosen and updated trimming or initialization factor may be a more reliable output for air/fuel ratio control than that resulting from the oxygen sensor output. Thus, in this embodiment, neither the output nor the trimming factor is changed on the basis of oxygen sensor information until the transport delay time has expired, since it is only after the transport delay time that the sensor responds to the mixture determined by the new trimming factor.

Returning to subroutine or decision point 233 of FIG. 12, the register number is then stepped up or down by subroutine 235 in response to the input from the oxygen sensor, beginning in the first major loop cycle in which the timer expires and continuing until the table address changes. Thus, the system begins closed loop control through the oxygen sensor with the register preset to the trimming factor value. The numbers inserted on the register upon each successive major cycle passing through routines 235 and 236 are cumulative, thus providing closed loop control with integrator action. To this extent the register referred to herein is an integrator, as indicated in FIG. 12.

In order to accomplish the learning function, wherein the trimming factors of RAM 215 are modified in response to the error sensed by the oxygen sensor after an engine transport delay time, a subroutine 236 is provided following subroutine 235 which causes the trimming factor at the new address to track the register contents. Of course, this could be a simple one-to-one track in which, during each computer cycle in which subroutine 235 is executed, the new register contents are inserted in the memory location of the new address in RAM 215. However, due to the binary nature of the oxygen sensory output, which is always either rich or lean, the trimming factor would then tend to oscillate about the actual desired factor by an amount greater than necessary. Thus, in this embodiment, the subroutine includes a simple mathematical filtering algorithm in which the new trimming factor (NEW) to be substituted in the appropriate new address of RAM 215 equals the old trimming factor (OLD) at that address plus or minus the difference between the register contents (INT) and the old trimming factor divided by a filter constant K, or, in equation form, $NEW = OLD \pm (INT - OLD)/K$. In any case, however, there are many methods by which the trimming factor may be updated in response to sensed oxygen content within the scope of this invention.

After subroutine 236, in each computer cycle in which it is executed, the computer then proceeds to subroutines 230 and 231, in which the register contents are read out or transformed to a duty cycle number and output to output counter 218. Thus, when the engine has been at a particular engine operating condition range for a time longer than the transport delay time, the system is in closed loop control in response to the oxygen sensor signal with the register having been initialized by the trimming factor specific to that engine operating condition range and that trimming factor is being continually updated also in response to the oxygen sensor signal. When the engine proceeds to a new engine operating condition range, the trimming factor of the engine operating condition range from which the engine just departed is, of course, no longer updated but is retained as the initialization factor for the register the next time that the engine returns to this particular engine operating condition range.

This invention is characterized in all of its embodiments by the identification, recurrently, of times when engine operation has been substantially unchanged, as determined by a parameter dependent upon engine operating condition with respect to certain predetermined engine operating conditions or condition ranges, for a time exceeding the engine transport delay. A stored trimming factor specific to that engine operating condition or condition range is then updated in direction to achieve a desired exhaust gas content. In its simplest form, the value of the parameter may be determined by sampling at the beginning and end of a test period exceeding in duration the engine transport delay, as described above with respect to FIGS. 9 and 10. A preferred arrangement is to sample many times during a test period exceeding the engine transport delay, as illustrated by FIGS. 3–8 and 11–12. In this latter arrangement, when a substantial change in the parameter is sensed, the test period is aborted and a new test period started immediately. In its most convenient form, applied to a digital system where engine operating parameters are sensed to update storage registers on a recurrent basis, the sampling for the apparatus and method herein described may be done concurrently with such updating, as illustrated in the apparatus of FIGS. 3–8 and 11–12. It may well happen that the invention, in this convenient form may comprise the simplest or preferred arrangements, as described above, at different times as the transport delay changes.

In the accompanying text and claims, whenever the word "successive" is used with respect to values of an engine operating condition or times, the word is used in its broadest sense as meaning that those values or times follow one another in succession, even though there may be other values or times interspersed between said successive values or times. In other words, the comparison of one engine operating condition with a successive engine operating condition may take place at a different repetition rate from the repetition rate at which the sensors are read or at which said engine operating condition is determined by the computer from sensor outputs.

The term "trimming factor" in the accompanying claims and text is used to denote a number or quantity having a value specific to an engine operating condition or condition range, which value is stored in memory means for use in helping to determine fuel supply at the engine operating condition or condition range and may be updated during engine operation. It is generally not the only factor which affects fuel supply and may, but need not necessarily, produce changes in fuel flow within a limited portion of the total range of variation of such flow. Many systems and ways of using a trimming factor in fuel control in conjunction with this invention will occur to those skilled in the art; therefore, the scope of this invention should be limited only by the claims which follow.

The embodiments of the invention in which an exclusive property or privilege is claimed are defined as follows:

1. In combination:

a motor vehicle engine having an exhaust discharge passage and a sensor responsive to the exhaust gas content therein;

fuel supply apparatus effective to supply fuel to the engine in amount determined by at least one trimming factor having a value specific to the value of an engine operating condition, the engine and fuel supply apparatus being characterized by a transport delay between the initiation of a change in fuel supply and the sensing of a resultant change in exhaust content;

first means effective to compare successive values of the engine operating condition and to provide a signal if the values are substantially the same for a time period at least equal to the transport delay; and second means effective, in response to the signal, to adjust the trimming factor specific to the value of the engine operating condition during the time period in accordance with the exhaust content as sensed after the time period in direction to produce a desired exhaust content.

2. A controller for a closed loop internal combustion engine system of the type wherein engine exhaust is supplied to a three-way catalytic converter, fuel is supplied to the engine in accordance with an engine operating condition and a stored trimming factor specific to the value of the engine operating condition and the oxidizing character of the engine exhaust is sensed by a sensor in contact therewith, the engine being characterized by a transport delay between the initiation of a change in fuel supply and the sensing of a resultant change in the oxidizing character of the engine exhaust, the controller comprising:

first means effective to compare successive values of the engine operating condition and produce a signal when said values are substantially unchanged for a time at least equal to the engine transport delay; and second means activated by the signal from the first means and responsive to the sensor to adjust the stored trimming factor corresponding to the substantially unchanged value of the engine operating condition in direction to produce an approach by the oxidizing character of the engine exhaust to a predetermined character for a desired operation of the catalytic converter.

3. In combination:

a motor vehicle engine having an exhaust discharge passage and a sensor responsive to the exhaust gas content therein;

fuel supply apparatus effective to supply fuel to the engine in amount determined by at least one trimming factor having a value specific to the value of an engine operating condition, the engine and fuel supply apparatus being characterized by a transport delay between the initiation of a change in fuel supply and the sensing of a resultant change in exhaust content;

means effective to compare the values of said engine operating condition at the beginning and at the end of each of a succession of contiguous sampling intervals each substantially shorter in duration than the engine transport delay period;

counting means effective to count the number of contiguous sampling intervals during which said engine operating condition is substantially constant and effective to terminate a count and subsequently restart counting if said operating condition substantially changes;

means effective in response to a count of said last means corresponding to a total period at least equal to the engine transport delay period to adjust the trimming factor specific to the substantially constant value of the engine operating condition in accordance with exhaust content sensed at the end of said period, in direction to produce a desired exhaust content.

4. In combination:

a motor vehicle engine having an exhaust discharge passage and a sensor responsive to exhaust gas content therein;

fuel supply apparatus effective to supply fuel to the engine in amount determined by at least one trimming factor having a value specific to the value of an engine operating condition, said apparatus including a storage register wherein a number representing such condition is recurrently entered many times for each transport delay time between the initiation of a change in fuel supply and the sensing of the resultant change in exhaust content;

a counter;

means effective substantially upon entry of each number into said storage register to compare the same with the number previously entered, to increment said counter if there is no substantial change and to reset the counter if there is a change, and;

means activated when the counter reaches a predetermined number corresponding to a time exceeding the engine transport delay time to adjust said trimming factor specific to the value of said engine operating condition in accordance with the engine exhaust content sensed substantially at the time of such activation.

5. In combination:

a motor vehicle engine having an exhaust discharge passage and a sensor responsive to the exhaust gas content therein;

fuel supply apparatus effective to supply fuel to the engine in amount determined by at least one engine operating condition and a trimming factor having a value specific to the value of the engine operating condition, the engine and fuel supply apparatus being characterized by a transport delay between the initiation of a change in fuel supply and the sensing of a resultant change in exhaust content;

first means effective to remember the value of the engine operating condition at a first time and the value at a second time later than the first time at least by the transport delay, to compare the values and to provide a signal if the values are substantially the same at the first and second times;

second means effective, in response to the signal, to actuate the sensor and adjust the trimming factor specific to the value of the engine operating condition at the first time in accordance with the exhaust content as sensed in direction to produce a desired exhaust content.

6. In combination:

a motor vehicle engine having an exhaust discharge passage and a sensor responsive to the exhaust gas content therein;

fuel supply apparatus effective to supply fuel to the engine in amount determined by at least one trimming factor having a value specific to the value of an engine operating condition, the engine and fuel supply apparatus being characterized by a transport delay between the initiation of a change in fuel supply and the sensing of a resultant change in exhaust content;

means effective to compare the values of said engine operating condition at least at the beginning and at the end of a succession of contiguous test periods each of which is at least as long in time as the engine transport delay period, and;

means effective when such values are substantially the same to adjust said trimming factor specific to the value of said engine operating condition in accordance with engine exhaust content sensed at the end of said period, in direction to produce a desired exhaust content.

7. Fuel supply apparatus for an internal combustion engine having exhaust means including means for sensing the exhaust content therein and further having means for determining fuel supply at least partially by a trimming factor which is a function of one or more engine operating variables, said fuel supply determining means including an addressable memory in which specific values of the trimming factor are stored at locations having addresses corresponding to particular ranges of values of said engine operating variables, said engine being characterized by a transport delay between the initiation of a change in fuel supply and the sensing of a resultant change in exhaust content, the fuel supply apparatus comprising, in combination:

first means effective to repeatedly sample the address of the memory means corresponding to successive values of said engine operating variables encountered during engine operation and generate a signal when said address is substantially unchanged for a time period at least equal to the transport delay; and second means effective, in response to the signal, to adjust the trimming factor at the substantially unchanged address in accordance with the exhaust content as sensed after the end of said time period in direction to produce a desired exhaust content.

8. Fuel supply apparatus for a motor vehicle engine having exhaust means including means for sensing the exhaust content therein and time-integrating the value of the exhaust content, the fuel supply apparatus comprising means for determining fuel supply at least partially by a trimming factor which is a function of at least one engine operating condition, the engine being characterized by a transport delay between the initiation of a change in fuel supply and the sensing of a resultant change in exhaust content, the fuel supply apparatus comprising, in combination:

first means effective to sample successive values of the engine operating condition and generate a signal when said values are substantially unchanged for a time period at least equal to the transport delay;

second means effective to compare the time-integrated value of the exhaust content, as provided by the exhaust content sensing and time integrating means, after said time period with a desired exhaust content and generate a signal indicating any difference therebetween, the time-integrated value of the exhaust content after said time period being at least partially determined by the fuel supply at the beginning of said time period;

third means responsive to signals from the first and second means to change the trimming factor corresponding to the value of the engine operating condition during said time period in sense and amount to eliminate the difference as indicated by the second means, whereby the trimming factor of the fuel supply apparatus is changed in engine operation to help maintain desired exhaust content; and fourth means effective, when the third means changes the trimming factor, to change the time-integrated value of the exhaust content to eliminate the difference as indicated by the second means, whereby overcorrection of the trimming factor due to the time delay effect of time integration of the sensed exhaust content is eliminated.

9. Fuel supply apparatus for a motor vehicle engine having exhaust means including means for sensing the exhaust content therein, the fuel supply apparatus comprising means for determining fuel supply at least partially by a trimming factor which is a function of at least one engine operating condition, the engine being characterized by a transport delay between the initiation of a change in fuel supply and the sensing of a resultant change in exhaust content, the fuel supply apparatus comprising, in combination:

first means effective to sample successive values of the engine operating condition and generate a first signal when said values are substantially unchanged for a time period at least equal to the transport delay;

second means responsive to said first signal to compare successive values of the time integrated value of the exhaust content, as sensed by the exhaust content sensing means, after said time period with a desired exhaust content, and generate a series of error signals therefrom, the time integrated value of the exhaust content after said time period being at least partially determined by the fuel supply at the beginning of said time period;

third means responsive to signals from the first and second means to compare each error signal with the preceding error signal and generate a second signal when the successive error signals stop moving toward a zero error value;

fourth means responsive to the second signal to change the value of the trimming factor corresponding to the value of the engine operating condition during the time period in sense and amount determined by the last generated error signal, whereby the correction of the trimming factor is delayed while the error signal moves towards zero to prevent unnecessary overcorrection and the apparatus thus helps maintain the desired exhaust content.

10. The method of operating a motor vehicle engine having means effective to supply fuel thereto in amount determined at least partially by a trimming factor which is a function of at least one engine operating condition and further in response to sensed exhaust content, the engine being characterized by a transport delay between the initiation of a change in fuel supply and a resulting change in exhaust content, the method comprising the steps of:

recurrently sampling said engine operating condition and determining when the sampled value of the engine operating condition has been substantially constant for a time period at least equal to the engine transport delay;

determining the exhaust content at the end of the time period when such determination is made; and adjusting the trimming factor specific to the sampled value during said time period in accordance with the determined exhaust content at the end of the time period in sense to bring the exhaust content to a predetermined desired content.

11. The method of operating a motor vehicle engine having means effective to supply fuel thereto in amount determined at least partially by a trimming factor which is a function of at least one engine operating condition and further in response to sensed exhaust content, the engine being characterized by a transport delay between the initiation of a change in fuel supply and a resulting change in exhaust content, the method comprising the steps of:

comparing the values of said engine operating condition at the beginning and at the end of each of the succession of contiguous sampling intervals, each substantially shorter in duration than the engine transport delay;

counting the number of contiguous sampling intervals during which said engine operating condition is substantially constant;

terminating said count and beginning a new count when said engine operating condition changes before the end of a count corresponding to a time at least as long as the engine transport delay;

determining the exhaust content at the end of a count corresponding to a time at least as long as the engine transport delay when said engine operating condition remains substantially constant during said entire count; and adjusting the trimming factor specific to said value of the engine operating condition in accordance with exhaust content sensed at the end of said count in direction to produce a desired exhaust content.

12. The method of operating a motor vehicle engine having means effective to supply fuel thereto and amount determined at least partially by a trimming factor which is a function of at least one engine operating condition and further in response to sensed exhaust content, the engine being characterized by a transport delay between the initiation of a change in fuel supply and a resulting change in exhaust content, the method comprising the steps of:

recurrently storing a number representing the engine operating condition at successive times spaced by intervals much shorter than the transport delay;

comparing each said stored number with the previously stored number and incrementing a count if said numbers are substantially the same;

restarting the count when said numbers are not substantially the same; and adjusting said trimming factor specific to the value of the unchanged engine operating condition, when the count reaches a predetermined count corresponding to a time at least equal to the transport delay, in accordance with the engine exhaust content sensed at the end of said time.

13. The method of operating a motor vehicle engine having means effective to supply fuel thereto in an amount determined at least partially by a trimming factor which is a function of at least one engine operating condition and further in response to sensed exhaust content, the engine being characterized by a transport delay between the initiation of a change in fuel supply and a resulting change in exhaust content, the method comprising the steps of:

comparing the values of said engine operating condition at the beginning and at the end of a succession of contiguous test periods, each of which is at least as long in time as the engine transport delay; and adjusting the value of the trimming factor specific to the value of the engine operating condition at the end of each interval in which the end value is substantially unchanged from the beginning value in accordance with engine exhaust content sensed at the end of said interval, in direction to produce a desired exhaust content.

14. The method of operating a motor vehicle engine having means effective to supply fuel thereto in an amount determined at least partially by a trimming factor which is a function of at least one engine operating condition and further in response to sensed exhaust content, the engine being characterized by a transport delay between the initiation of a change in fuel supply and a resulting change in sensed exhaust content, the method comprising the steps of:

comparing the values of said engine operating condition at the beginning and at the end of each of a succession of contiguous sampling intervals;

operating the engine from a previously stored trimming factor specific to the current one of a plurality of ranges of said one engine operating condition;

storing a new trimming factor determined by sensed exhaust content at the end of a time period at least equal to the engine transport delay, during which time period said engine operating condition remains in said one range as determined by at least one of said successive comparisons;

updating said fuel trim factor on the basis of sensed exhaust content at the conclusion of each successive sampling interval thereafter so long as the engine operating condition remains in said one range as determined by said successive comparisons, and;

returning to said operation from a previously stored value of trim factor specific to a new range of said engine operating condition when the engine operating condition enters said new range, while retaining the last stored trimming factor for said one range for recall as the previously stored value when the engine is next operated within that range.

* * * * *